United States Patent [19]

Dieleman et al.

[11] 4,348,610

[45] Sep. 7, 1982

[54] CAMERA TUBE WITH GRADED TELLURIUM OR ARSENIC TARGET

[75] Inventors: Jan Dieleman; Joannes H. J. Van Dommelen; Petrus J. A. M. Derks, all of Eindhoven, Netherlands

[73] Assignee: U.S. Philips Corporation, New York, N.Y.

[21] Appl. No.: 130,891

[22] Filed: Mar. 17, 1980

[30] Foreign Application Priority Data

Apr. 11, 1979 [NL] Netherlands ..... 7902838

[51] Int. Cl.[3] ..... H01J 29/45; H01J 31/38

[52] U.S. Cl. ..... 313/386

[58] Field of Search ..... 313/385, 386

[56] References Cited

U.S. PATENT DOCUMENTS 3,890,525 6/1975 Hirai et al. ..... 313/386

4,040,985 8/1977 Shidara et al. ..... 313/385

*Primary Examiner*—Eli Lieberman

*Attorney, Agent, or Firm*—Robert J. Kraus

[57] ABSTRACT

A camera tube target (9) which is to be scanned on one side by an electron beam (20), comprises a selenium-containing vitreous layer (21) also containing tellurium and arsenic. In order to improve various target characteristics and properties in accordance with the invention, the concentration of at least one of the elements tellurium and arsenic in a first sub-layer (25) of the selenium-containing layer (21), on the side to be scanned, increases toward the side to be scanned to a value at which the sum of the concentrations of tellurium and arsenic is at most 30 at. %. The arsenic concentration everywhere in the layer (21) exceeds 1.5 at. %. In a second sub-layer (26) adjoining the first sub-layer (25) the concentration of at least one of the elements arsenic and tellurium is smaller than its concentration an adjoining third sub-layer (27). A fourth sub-layer (28) may also be present between the third sub-layer (27) and the signal electrode (22). The concentration of arsenic and/or tellurium in the third sub-layer (27) is larger than its concentration in the fourth sub-layer.

7 Claims, 2 Drawing Figures

CAMERA TUBE WITH GRADED TELLURIUM OR ARSENIC TARGET

BACKGROUND OF THE INVENTION

The invention relates to a camera tube having an electron source and a target to be scanned on one side by an electron beam emanating from the source. The target has a selenium-containing vitreous layer also containing the elements tellurium and arsenic, the concentration of at least one of these elements varying across the thickness of the vitreous layer.

A camera tube having the features specified in the opening paragraph is disclosed in British Patent Specification No. 1135460.

A problem with vitreous selenium layers is that they are not very sensitive to long-wave radiation. Additions, such as tellurium are therefore often used to improve sensitivity.

In addition, for achieving good operation of the camera tube it is of importance inter alia to suitably block injection of electrons from the electron beam into the selenium-containing vitreous layer so as to minimize dark current, lag and burning-in of an after-image. Moreover, the stability of the camera tube characteristics, for example the stability of the selenium-containing vitreous layer, should be high and the camera tube should be simple to manufacture.

The dark current and the lag, however, may be considerable if high tellurium concentrations are used, which may be the case, for example, when tellurium is present in the whole thickness of the selenium-containing vitreous layer. Moreover, the glass stability of the selenium-containing vitreous layer may be low as a result of the low concentration of arsenic as a glass-stabilizing addition as mentioned in the British patent specification.

SUMMARY OF THE INVENTION

One of the objects of the invention is to provide a camera tube having improved properties, such as good blocking against electron injection from the electron beam.

The invention is inter alia based on the recognition that good blocking against electron injection can be obtained while maintaining other desirable properties if the tellurium and/or arsenic concentration increases only over a part of the thickness of the selenium-containing vitreous layer on the side to be scanned.

In accordance with the invention, a camera tube is characterized in that the selenium-containing vitreous layer includes, on the side to be scanned, a first sub-layer in which the concentration of at least one of the elements tellurium and arsenic increases across the sub-layer's thickness toward the side to be scanned. The concentration increases to a value at which the sum of the concentrations of tellurium and arsenic on the side to be scanned is at most 30 at. % (atomic percent). The arsenic concentration everywhere in the selenium-containing vitreous layer is larger than 1.5 at. %. The selenium-containing vitreous layer includes, adjoining the first sub-layer a second sub-layer in which the concentration of at least one of the elements arsenic and tellurium is smaller than its concentration in a third sub-layer and joining the second sub-layer.

It has been found that with such an increased concentration of arsenic and/or tellurium over only a part of the thickness of the selenium-containing vitreous layer on the side to be scanned, very satisfactory blocking against electron injection from the electron beam can be obtained with sufficient resolution. The stability of camera tubes made in accordance with the invention can be considerably better than that of camera tubes having a known layer, such as arsenic triselenide, for blocking against electron injection. Good glass stabilization of the selenium-containing vitreous layer and small lag can also be obtained by providing more than 1.5 at. % arsenic in the selenium-containing layer.

A further advantage of the first sub-layer having the specified composition (as compared with a known blocking layer of antimony trisulfide) is that the signal electrode voltage of the tube may be lower and the layer can be simpler to form.

The advantages described become particularly apparent if the sum of the concentrations of arsenic and tellurium in the first sub-layer on the side to be scanned is larger than 8.5 at. %.

In order to obtain good thermal stability and good blocking the first sub-layer is preferably thicker than 0.1 μm.

The advantage of low signal electrode voltage is accomplished if the first sub-layer is thinner than 1 μm.

In order to avoid the burning of an after-image the concentration of tellurium in the second sub-layer of the selenium-containing vitreous layer is preferably smaller than 4 at. % and the tellurium may even be entirely absent from the second sub-layer.

The concentration of at least one of the elements arsenic and tellurium in the third sub-layer of the selenium-containing vitreous layer preferably is larger than its concentration in a fourth sub-layer adjoining the third sub-layer. With such a fourth sub-layer adjoining the signal electrode the red sensitivity of the selenium-containing vitreous layer is improved, as is the temperature stability and blocking action against injection of holes.

BRIEF DESCRIPTION OF THE DRAWING

An embodiment of this invention with specific examples will now be described with reference to the accompanying drawing.

In this drawing.

DESCRIPTION OF THE PREFERRED EMBODIMENT

Figure 1:
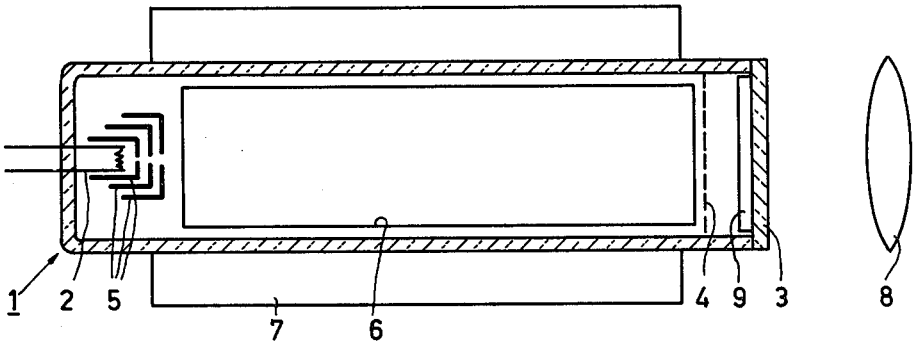
FIG. 1 is a diagrammatic sectional view of a camera tube in accordance with the invention.
Figure 2:
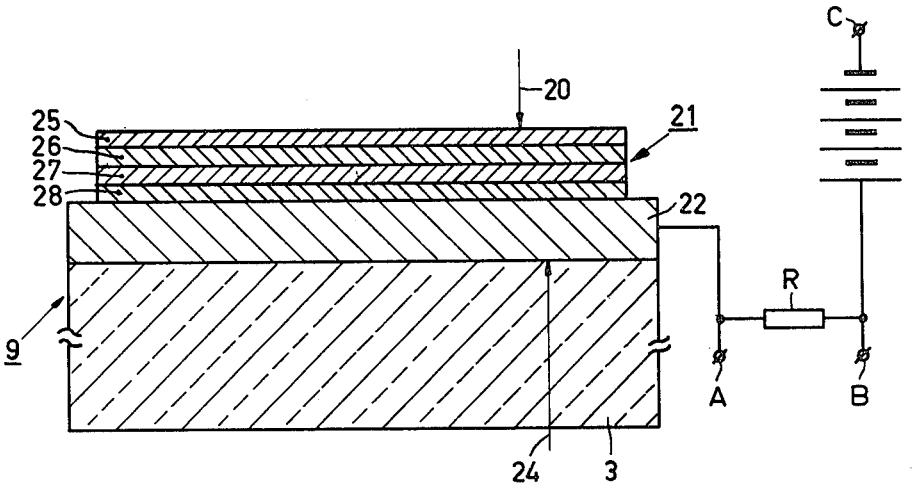
FIG. 2 is a diagrammatic sectional view of a part of the target of the camera tube of FIG. 1.

The camera tube 1 shown in FIG. 1 has an electron source 2 and a target 9 (see also FIG. 2) which is to be scanned on one side by an electron beam 20 emanating from said source. The target 9 has a selenium-containing vitreous layer 21 which also contains the elements tellurium and arsenic. The concentration of at least one of these elements (tellurium and arsenic) varies in the direction of thickness of the selenium-containing layer 21.

In accordance with the invention the selenium-containing layer 21 includes, on the side to be scanned, a first sub-layer 25 in which the concentration of at least one of the elements tellurium and arsenic increases across its thickness toward the side to be scanned up to a value at which the sum of the concentrations of tellurium and arsenic on the side to be scanned is at most 30 at. %. The arsenic concentration everywhere in the selenium-containing layer is larger than 1.5 at. %. The selenium-containing layer includes, adjoining the first sub-layer 25, a second layer portion 26 in which the concentration of at least one of the elements arsenic and tellurium has a minimum value with respect to a third sub-layer 27 adjoining the second sub-layer 26.

The camera tube comprises conventional electrodes 5 to accelerate electrons and to focus the electron beam and means such as a system of coils 7 to deflect the electron beam, so that the target 9 can be scanned. The electrode 6 serves inter alia to screen the tube wall from the electron beam. A scene to be picked up is projected on the target 9 by means of a lens 8, the tube having its window 3 permeable to radiation.

Furthermore, a collector grid 4 is present in the usual manner. By means of this grid 4 which, for example may also be an annular electrode, reflected and secondary electrons coming from the target 9 can be drained.

During operation, a signal electrode 22 is biased positive with respect to the electron source 2. In the circuit arrangement shown in FIG. 2, the electron source must be connected to the point C. Upon scanning the target with the electron beam 20, the target is charged to substantially the cathode potential.

The target is then discharged entirely or partly, depending on the intensity of the radiation 24 which impinges on the selenium-containing layer 21. In a subsequent scanning cycle, charge is again supplied until the target has again assumed the cathode potential. The charging current is a measure of the intensity of the radiation 24. Output signals are derived at the terminals A and B via the resistor R.

The sum of the concentrations of arsenic and tellurium in the first sub-layer 25 is preferably larger than 8.5 at. % and the thickness of the sub-layer 25 is between 0.1 and 1 μm.

Furthermore the tellurium concentration in the second sub-layer 26 of the selenium-containing layer 21 is preferably smaller than 4 at. % or the tellurium is entirely absent therefrom.

The red sensitivity of the camera tube is improved if the concentration of at least one of the elements arsenic and tellurium in the third sub-layer 27 of the selenium-containing layer 21 has a maximum value with respect to a fourth sub-layer 28 adjoining the third sub-layer. The fourth sub-layer 28 of the selenium-containing layer 21 may be used to reduce injection of holes from the signal electrode 22.

In the following examples there were provided in the usual manner on a transparent glass window 3 a transparent signal electrode 22 consisting of tin oxide, indium oxide or tin-doped indium oxide etc. and then the selenium-containing vitreous layer 21. The layer 21 was formed by providing successively in a high-vacuum device, the fourth sub-layer 28, the third sub-layer 27, the second sub-layer 26 and the first sub-layer 25.

EXAMPLE I

The composition and the thicknesses of the sub-layers are recorded in Table I.

TABLE I

| sub-layer | thickness in μm | composition in at. % Se | As | Te |
|---|---|---|---|---|
| 4th (28) | 0.2 | 94 | 6 | 0 |
| 3rd (27) | 0.2 or 0.6 | 82.5 | 9 | 8.5 |
| 2nd (26) | 2.8 | 96 | 4 | 0 |

TABLE I-continued

| sub-layer | thickness in μm | composition in at. % Se | As | Te |
|---|---|---|---|---|
| 1st (25) | 0.4 | 96–83 | 4–8.5 | 0–8.5 |

In the table the notation 96–83 indicates a selenium concentration which decreases progressively from 96 atomic percent at the side of the first sub-layer 25 adjoining the second sub-layer 26 to 83 atomic percent at the side to be scanned, while the arsenic and tellurium concentrations in the sub-layer 25 correspondingly increase from 4 to 8.5 atomic percent and from 0 to 8.5 atomic percent, respectively. The targets were assembled into television camera tubes.

At suitably chosen signal electrode voltages, a good spectral distribution of sensitivity to visible light was found.

The targets having a third sub-layer 27 with a thickness of 0.6 μm had a higher sensitivity to long wave light than those with a thickness of 0.2 μm. For both thicknesses a low dark current and a small after-image was found and an excellent response rate was recorded with bias light of low-intensity.

An after-treatment in vacuum at 80° C. for 4 hours had only a small influence on the said properties.

EXAMPLE II

The compositions and the thicknesses of the sub-layers are recorded in Table II.

TABLE II

| sub-layer | thickness in μm | composition in at. % Se | As | Te |
|---|---|---|---|---|
| 4th (28) | 0.15 | 96.5 | 3.5 | 0 |
| 3rd (27) | 0.25 | 83.5 | 4 | 12.5 |
| 2nd (26) | 3.4 | 97.5 | 2.5 | 0 |
| 1st (25) | 0 or 0.2 | 97.5–80 | 2.5–5 | 0–15 |

After assembling the resulting targets into television camera tubes it was found that the targets without a first sub-layer 25 had a high dark current and a low response rate; the burning-in of an after-image was also inadmissibly high. At high signal electrode voltages the quantum efficiency exceeded 100%.

On the contrary the targets having a first sub-layer 25 with a thickness of 0.2 μm had a good spectral distribution of sensitivity for visible light with suitably chosen signal electrode voltages. After-image and dark current were also small and with a low bias light of the target the response rate was excellent.

EXAMPLE III

The compositions and the thicknesses of the sub-layers are recorded in Table III.

TABLE III

| sub-layer | thickness in μm | composition in at. % Se | As | Te |
|---|---|---|---|---|
| 4th (28) | 0.2 | 89.5 | 10.5 | 0 |
| 3rd (27) | 1.0 | 87.5 | 4 | 8.5 |
| 2nd (26) | 2.8 | 89.5 | 10.5 | 0 |
| 1st (25) | 0.1 or 0.2 or 0.5 | 89.5–81 | 10.5–9 | 0–10 |

The targets thus obtained were assembled into television camera tubes.

A good spectral distribution of sensitivity to visible light were measured, the dark current was small and the response rate was excellent.

When a thicker first sub-layer 25 was used it was found that a slightly higher signal electrode voltage was necessary to achieve the same sensitivity as in a thinner first sub-layer 25.

The response rate in thicker first sub-layers, however, was still better than in thinner sub-layers and even at high light levels no visible after-image occurred.

The first sub-layer 25 with a thickness of 0.1 μm had a slightly smaller blocking effect than first sub-layers with thicknesses 0.2 and 0.5 μm, but it was still sufficient.

EXAMPLE IV

The compositions and the thickness of the sub-layers are recorded in table IV.

TABLE IV

| sub-layer | thickness in μm | composition in at. % Se | As | Te |
|---|---|---|---|---|
| 4th (28) | 0.2 | 93.5 | 6 | 0.5 |
| 3rd (27) | 0.5 | 81 | 7 | 12 |
| 2nd (26) | 2 | 95.5 | 4.5 | 0 |
| 1st (25) | 0.3 | 95.5–77.5 | 4.5–9 | 0–13.5 |

At comparatively low signal electrode voltages the television camera tubes obtained by means of these targets showed a good spectral distribution of sensitivity to visible light. Both the sensitivity to long-wave light and the response rate with low bias light was excellent. There was no visible after-image and the dark current was small.

EXAMPLE V

The compositions and the thicknesses of the sub-layers are recorded in Table V.

TABLE V

| sub-layer | thickness in μm | composition in at. % Se | As | Te |
|---|---|---|---|---|
| 4th (28) | 0.1 | 93 | 7 | 0 |
| 3rd (27) | 0.2 | 78.5 | 8 | 13.5 |
| 2nd (26) | 3.4 | 90.5–84 | 9.5–16 | 0 |
| 1st (25) | 0.2 | 84–74 | 16–11 | 0–15 |

In the second sub-layer 26 the arsenic content increased continuously and gradually from 9.5 on the side adjoining the third sub-layer 27 to 16 at. % on the side adjoining the first sub-layer 25 and the selenium content decreased correspondingly.

After assembling the targets on television camera tubes a good spectral distribution of sensitivity to visible light, a hardly observable after-image and an excellent response rate with low bias light of the target was found.

EXAMPLE VI

The compositions and the thicknesses of the sub-layers are recorded in table VI.

TABLE VI

| sub-layer | | | thickness in μm | composition in at. % Se | As | Te |
|---|---|---|---|---|---|---|
| 4th | | (28) | 0.1 | 93–88 | 2.5–3 | 4.5–9 |
| 3rd | A | (27) | 0.2 | 88 | 3 | 9 |
| | B | | 0.1 | 88–97 | 3–2.5 | 9–0.5 |
| 2nd | | (26) | 3.8 | 97 | 2.5 | 0.5 |

TABLE VI-continued

| sub-layer | | | thickness in μm | composition in at. % Se | As | Te |
|---|---|---|---|---|---|---|
| 1st | A | (25) | 0.1 | 97–83 | 2.5–4 | 0.5–13 |
| | B | | 0.4 | 83 | 4 | 13 |

In the fourth sub-layer 28 the selenium content decreased continuously from 93 at. % on the side of the signal electrode 22 to 88 at. % on the side adjoining the sub-layer A of the third sub-layer 27.

Simultaneously the arsenic content increased from 2.5 to 3 and the tellurium content from 4.5 to 9 at. %. In sub-layer B of the third sub-layer the selenium content increased from 88 to 97 at. % while the arsenic content decreased from 3 to 2.5 and the tellurium content from 9 to 0.5 at. %.

In sub-layer A of the first sub-layer 25 the concentrations again varied from the second sub-layer 26 to sub-layer B of the first sub-layer as stated in the table.

At suitably chosen signal electrode voltages the television camera tubes provided with the targets described showed a good spectral distribution of sensitivity to visible light, a low dark current and an excellent response rate with low bias light of the target.

EXAMPLE VII

The compositions and the thicknesses of the sub-layers are recorded in table VII.

TABLE VII

| layer | | | thickness in μm | composition in at. % Se | As | Te |
|---|---|---|---|---|---|---|
| 4th | | (28) | 0.1 | 97.5–87.5 | 2.5 | 0–10 |
| 3rd | A | (27) | 0.35 | 87.5 | 2.5 | 10 |
| | B | | 0.1 | 87.5–97.5 | 2.5 | 10–0 |
| 2nd | | (26) | 3 | 97.5–97 | 2.5–3 | 0 |
| 1st | A | (25) | 0.1 | 97–80.5 | 3–4.5 | 0–15 |
| | B | | 0.35 | 80.5 | 4.5 | 15 |

In the television camera tubes manufactured with this target a good spectral distribution of sensitivity at suitably chosen signals electrode voltages was measured. In particular at slightly higher signal electrode voltages no burning-in of an after-image was observable even at high signal currents. With low bias light of the target an excellent response rate was observed.

The invention is not restricted to the examples described. The composition of the selenium-containing vitreous layer can be varied in various manners while still remaining within the scope of the invention. For example, in the first sub-layer the arsenic concentration alone may increase. Also, for example, a layer of, cerium oxide, molybdenum oxide or cadmium selenide may be provided between the signal electrode and the selenium-containing layer. An extra layer may also be provided on the first sub-layer. Certain trace contaminations in the selenium-containing layer, such as sulphur, iodine, bismuth etc. in concentrations up to about ten ppm have also proved to have no disturbing influence, and so may be present.

What is claimed is:

1. A camera tube including an electron source and a target to be scanned on one side by an electron beam emanating from the source, said target comprising a vitreous layer containing the elements selenium, tellurium and arsenic, the concentration of at least one of these elements varying across the thickness of the vitreous layer, characterized in that said layer comprises a plurality of sub-layers, starting at the side to be scanned by the electron beam, including:

(a) a first sub-layer in which the concentration of at least one of the elements tellurium and arsenic increases, toward the side to be scanned, to a concentration at which the sum of the concentrations of tellurium and arsenic is at most 30 atomic percent;

(b) a second sub-layer; and (c) a third sub-layer in which the concentration of at least one of the elements tellurium and arsenic is larger than its concentration in the second sub-layer;

the arsenic concentration everywhere in the vitreous layer being larger than 1.5 atomic percent.

2. A camera tube as in claim 1, characterized in that the sum of the concentrations of arsenic and tellurium in the first sub-layer on the side to be scanned is larger than 8.5 at. %.

3. A camera tube as in claim 1 or 2, characterized in that the first sub-layer is thicker than 0.1 μm.

4. A camera tube as in claim 1 or 2, characterized in that the first sub-layer is thinner than 1 μm.

5. A camera tube as in claim 1 or 2, characterized in that the tellurium concentration in the second sub-layer is smaller than 4 at. %.

6. A camera tube as in claim 5, characterized in that tellurium is absent from the second sub-layer.

7. A camera tube as in claim 1 or 2, characterized in that said vitreous layer includes a fourth sub-layer wherein the concentration of at least one of the elements tellurium and arsenic is smaller than its concentration in the third sub-layer.

* * * * *